US009517374B2

(12) United States Patent
Alexandrov et al.

(10) Patent No.: US 9,517,374 B2
(45) Date of Patent: Dec. 13, 2016

(54) AIR STRAPS

(71) Applicant: Velex Corp., Cambridge, MA (US)

(72) Inventors: Kiril Stefan Alexandrov, Cambridge, MA (US); Peter Hristov Velikin, Boston, MA (US)

(73) Assignee: Velex Corporation, Cambridge, MA (US)

( * ) Notice: Subject to any disclaimer, the term of this patent is extended or adjusted under 35 U.S.C. 154(b) by 87 days.

(21) Appl. No.: 14/250,110

(22) Filed: Apr. 10, 2014

(65) Prior Publication Data

US 2015/0133277 A1 May 14, 2015

Related U.S. Application Data

(60) Provisional application No. 61/903,918, filed on Nov. 13, 2013.

(51) Int. Cl.
*A63B 21/00* (2006.01)
*A63B 21/068* (2006.01)
(Continued)

(52) U.S. Cl.
CPC ..... *A63B 7/02* (2013.01); *A63B 21/068* (2013.01); *A63B 21/16* (2013.01); *A63B 21/1636* (2013.01); *A63B 21/4015* (2015.10); *A63B 21/4035* (2015.10); *A63B 23/03541* (2013.01); *A63B 2208/02* (2013.01); *A63B 2208/0285* (2013.01); *A63B 2220/17* (2013.01); *A63B 2220/51* (2013.01); *A63B 2220/803* (2013.01);
(Continued)

(58) Field of Classification Search
CPC ..... A63B 7/00–7/02; A63B 21/000185; A63B 21/00094–21/00101; A63B 21/0023; A63B 21/068; A63B 21/1446; A63B 21/1465–21/1469; A63B 21/1627–21/1663
See application file for complete search history.

(56) References Cited

U.S. PATENT DOCUMENTS 3,937,461 A 2/1976 Lew
4,125,257 A 11/1978 Lew
(Continued)

OTHER PUBLICATIONS

TRX Suspension & Rip Trainers, available at http://www.trxtraining.com/shop/gear. Last accessed on Apr. 8, 2014.
(Continued)

*Primary Examiner* — Oren Ginsberg
*Assistant Examiner* — Jennifer M Deichl
(74) *Attorney, Agent, or Firm* — Jeffrey T. Holman

(57) ABSTRACT

A fitness device for fully suspending a user in air includes at least four holds, at least four strap segments, and at least one attachment member. Each hold is configured to allow a user to interface with a hand or a foot. The four holds are configured to allow a single user to concurrently interface the four holds with a separate hand or foot. At least one strap segment is adjustable in length between the corresponding hold and a suspension point. The strap segments are configured to move independently of each other strap segment. The at least one attachment member is configured to attach to a corresponding mounting support structure to enable a user to fully suspend the user's body from a ground surface by contact with the holds.

18 Claims, 6 Drawing Sheets

(51) Int. Cl.
*A63B 21/16* (2006.01)
*A63B 23/035* (2006.01)
*A63B 7/02* (2006.01)

(52) U.S. Cl.
CPC ..... *A63B 2220/806* (2013.01); *A63B 2225/09* (2013.01); *A63B 2225/685* (2013.01)

(56) References Cited

U.S. PATENT DOCUMENTS

| | | | | |
|---|---|---|---|---|
| 5,178,590 | A | 1/1993 | Stephens | |
| 5,662,555 | A * | 9/1997 | Cloutier | 482/23 |
| 6,726,606 | B2 * | 4/2004 | Jacobsen | 482/121 |
| 7,044,896 | B2 | 5/2006 | Hetrick | |
| 7,090,622 | B2 | 8/2006 | Hetrick | |
| 8,007,413 | B1 | 8/2011 | Wu | |
| 8,083,653 | B2 | 12/2011 | Hetrick | |
| 8,197,392 | B2 | 6/2012 | Silverman et al. | |
| 8,506,462 | B2 | 8/2013 | Gregor et al. | |
| 2003/0216220 | A1 * | 11/2003 | Rota | 482/27 |
| 2007/0173383 | A1 * | 7/2007 | Feigenbaum et al. | 482/91 |
| 2012/0100968 | A1 * | 4/2012 | Tilton et al. | 482/131 |
| 2013/0217544 | A1 * | 8/2013 | Anaya | A63B 21/1627 482/40 |
| 2014/0274430 | A1 * | 9/2014 | Giordano | 472/118 |

OTHER PUBLICATIONS

Omni Gym and YogaSwing, available at http://www.yogaswings.com/image-gallery/. Last accessed on Apr. 8, 2014.

Primal 7, available at http://primal7.com. Last accessed Apr. 8, 2014.

Gorilla Door Gym, available at https://www.indiegogo.com/projects/gorilla-door-gym. Last accessed Apr. 8, 2014.

Gorilla Gym AirStraps, available at http://gorilla-gym.com/products/airstraps/. Last accessed Apr. 8, 2014.

AirStraps Install Instructions, available at https://www.youtube.com/watch?v=4QVQw1Myc7M&noredirect=1. Last accessed Apr. 8, 2014.

* cited by examiner

AIR STRAPS

CROSS-REFERENCE TO RELATED APPLICATIONS

This application claims the benefit of U.S. Provisional Application No. 61/903,918 filed on Nov. 13, 2013, which is incorporated by reference herein in its entirety.

BACKGROUND

The present disclosure relates to an exercise device, method, and system designed to use a user's own weight as resistance to train and exercise various muscle groups and engage a user's core muscles while suspending the user in the air. Yoga swings and other exercise devices have used straps to interface with a user while exercising. Yoga swings typically employ a swing or similar support structure to support the torso of a user while performing yoga poses and may provide handles for comfort and ease.

SUMMARY

Embodiments described herein are directed to a fitness device that enables a user to perform a variety of exercises and movements while in a position of full-body suspension. This type of fitness also may be referred to as aerial fitness. Embodiments of a fitness device for fully suspending a user in air are described. In one embodiment, a fitness device for fully suspending a user in air includes at least four holds, at least four strap segments, and at least one attachment member. Each hold is configured to allow a user to interface with a hand or a foot. The four holds are configured to allow a single user to concurrently interface the four holds with a separate hand or foot. At least one strap segment is adjustable in length between the corresponding hold and a suspension point. The strap segments are configured to move independently of each other strap segment. The at least one attachment member is configured to attach to a corresponding mounting support structure to enable a user to fully suspend the user's body from a ground surface by contact with the holds. Other embodiments of the fitness device are also described.

Embodiments of a method for fully suspending a user in air by fitness straps are also described. In one embodiment, the method includes inserting a user's hands and feet into four holds of a fitness device and suspending the user in air by contacting the four holds. The fitness device includes at least four holds, at least four strap segments, and at least one attachment member. Each hold is configured to allow a user to interface with a hand or a foot. The four holds are configured to allow a single user to concurrently interface the four holds with a separate hand or foot. At least one strap segment is adjustable in length between the corresponding hold and a suspension point. The strap segments are configured to move independently of each other strap segment. The at least one attachment member is configured to attach to a corresponding mounting support structure to enable a user to fully suspend the user's body from a ground surface by contact with the holds. Other embodiments of the method for fully suspending a user in air by fitness straps are also described.

Embodiments of a system for fully suspending a user in air to exercise are also described. In one embodiment, the system includes a mounting support structure and a strap structure connected to the mounting support structure. The strap structure includes at least four holds, at least four strap segments, and at least one attachment member. Each hold is configured to allow a user to interface with a hand or a foot. The four holds are configured to allow a single user to concurrently interface the four holds with a separate hand or foot. At least one strap segment is adjustable in length between the corresponding hold and a suspension point. The strap segments are configured to move independently of each other strap segment. The at least one attachment member is configured to attach to a corresponding mounting support structure to enable a user to fully suspend the user's body from a ground surface by contact with the holds. Other embodiments of the system for fully suspending a user in air to exercise are also described.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

Throughout the description, similar reference numbers may be used to identify similar elements.

DETAILED DESCRIPTION

Figure 1:
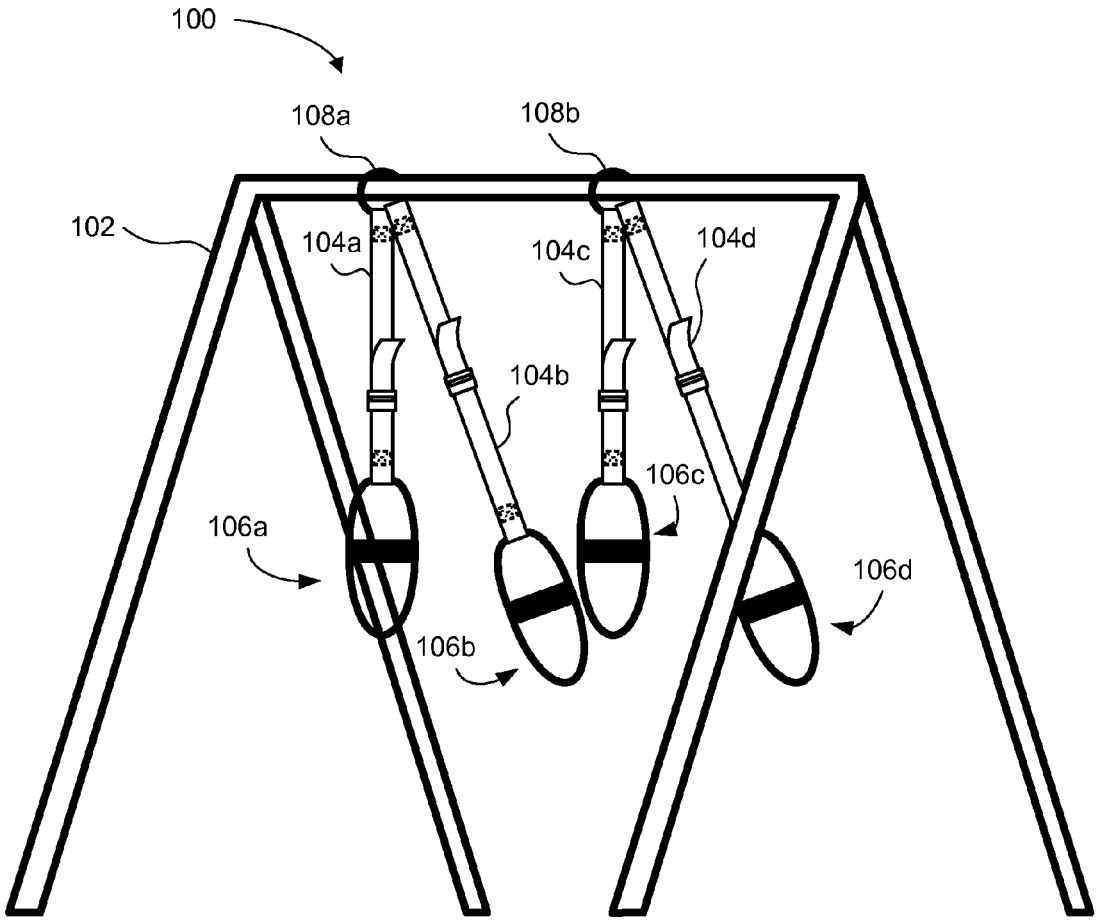
FIG. 1 depicts one embodiment of a fitness system for fully suspending a user in the air to exercise including a mounting support structure.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

Although many embodiments are described herein, at least some of the embodiments are designated as "air straps" in reference to the ability of a user to perform workout exercises and movements while his or her body is fully suspended off the ground. The types of exercises and movement that might be performed are virtually endless, including cardio exercises, strength training exercises, core exercises, stretching, running, and so forth. Some embodiments allow for a compact fitness device that can be used in commercial gyms or households and allow a comprehensive workout without requiring much space.

In some embodiments, when a user is suspended using an air straps fitness device, the user's entire body is balancing and re-balancing itself over the duration of the exercise or workout. This engages most or all of the user's muscle groups for a comprehensive workout. While the results of such workouts may vary, typical functions include, but are not limited to working glutes for a fit sculpted look, working core for the flattest stomach, shaping legs, toning quads, slimming hips, toning arms, define the back, sculpting the chest, developing bigger shoulders and biceps. Other muscular and/or cardiovascular results can also be achieved.

Multiple studies show continuous resistance exercise programs combining cardio and strength training can deliver dramatically better results. By elevating the heart rate through cardiovascular exercise, a user's strength training becomes much more effective. This allows results to be achieved in a shorter amount of time. Just like playing sports, using multiple muscles at the same time can result in faster physical effects. In some embodiments, a user balances and rebalances on the air straps fitness device, while the user's entire body is engaged in a more natural motion so the user can sculpt a body which will have a more natural look. Additionally, running and other similar exercise motion using "air straps" allow for a low-impact on joints. Various advantages of embodiments may include exercising while engaging core muscles because no torso support member is present to support the torso of a user.

Various configurations of the straps can be implemented. In general, each embodiment of the "air straps" fitness device includes at least three hand/foot holds, at least three lead straps, each one attaching to a corresponding hand/foot hold, and at least one attachment structure, each one to attach one or more straps to a mounting support structure.

FIG. 1 depicts one embodiment of a fitness system 100 for fully suspending a user in the air to exercise including a mounting support structure 102. Although the illustrated fitness system 100 is shown and described with certain components and functionality, other embodiments of the fitness system 100 may include fewer or more components to implement less or more functionality. The illustrated fitness system 100 includes a mounting support structure 102, straps or straps segments 104*a*-104*d*, holds 106*a*-106*d*, and attachment members 108*a*-108*b*.

Although not depicted, the fitness system 100 may include other components to facilitate the suspension of a user in the air to exercise.

Fitness system 100 may be used to suspend a user in the air. A user may interface the holds 106*a*-106*d* of the fitness system 100 and perform a variety of exercises and resistance training all while suspending himself or herself in the air.

For example, a user's hands may interface holds 106*a* and 106*c* while the user's feet interface holds 106*b* and 106*d*. The use of four holds 106*a*-106*d* allows a single user to concurrently interface each hold 106*a*-106*d* with a separate hand or foot. Various exercises may then be performed while suspended in the air.

In the illustrated embodiment each hold 106*a*-106*d* is connected to an individual strap 104*a*-104*d*. Straps 104*a*-104*d* are adjustable in length between a corresponding hold 106*a*-106*d* and a corresponding suspension point at an attachment member 108*a*-108*b*. For example, strap 104*a* may be adjusted in length between the hold 106*a* and the attachment member 108*a*. In some embodiments, one or all of the straps 106*a*-106*d* are adjustable in length. In some embodiments, one or all of the straps or strap segments are not adjustable in length. The straps 106*a*-106*d* may be individually adjustable or adjustable together.

While many embodiments may include more than four holds or more than four straps, some embodiments exclude a supporting member, swing, hammock, strap, seat, or other mechanism to support some or all of a user's torso. Some embodiments herein omit such structures to support a user's torso. The absence of a torso supporting mechanism forces the user to balance and re-balance throughout a workout, therefore engaging all of the user's muscle groups for a comprehensive workout in a short period of time. Workouts may include strength and resistance training, cardio training, running, and workout routines that target muscle groups. Many of these workouts may be accomplished with little to no impact compared to running and jumping of traditional workouts.

The straps 104*a*-104*d* are connected to attachment members 108*a* and 108*b*. The number of attachment members 108 may vary. In some embodiments, all straps 104*a*-104*d* are attached to a single attachment member 108. In some embodiments, each individual strap 104*a*-104*d* is attached to a separate attachment member 108. In the illustrated embodiment, straps 104*a* and 104*b* are connected to attachment member 108*a* while straps 104*c* and 104*d* are connected to attachment member 108*b*. Attachment members 108*a*-108*b* may be, but are not limited to, rings, carabiners, loops, hooks, grommets, or other structures capable of attaching the straps 104*a*-104*d* to a mounting support structure 102.

In the illustrated embodiment, the mounting support structure 102 is an A-frame. The attachment members 108*a* and 108*b* attach to a cross bar of the A-frame mounting support structure 102. The mounting support structure 102 varies in embodiments, as is illustrated by the embodiments described herein. The mounting support structure 102 may be a pull-up bar or other bar attached to a wall, ceiling, or mounting frame. The mounting support structure 102 may be a hook, a ring, or similar structure attached to a wall, ceiling, or mounting frame. The mounting support structure 102 may be a pull-up bar inserted and supported by a door frame. All embodiments of a mounting support structure 102 are not described herein and include those known by those skilled in the art.

Figure 2:
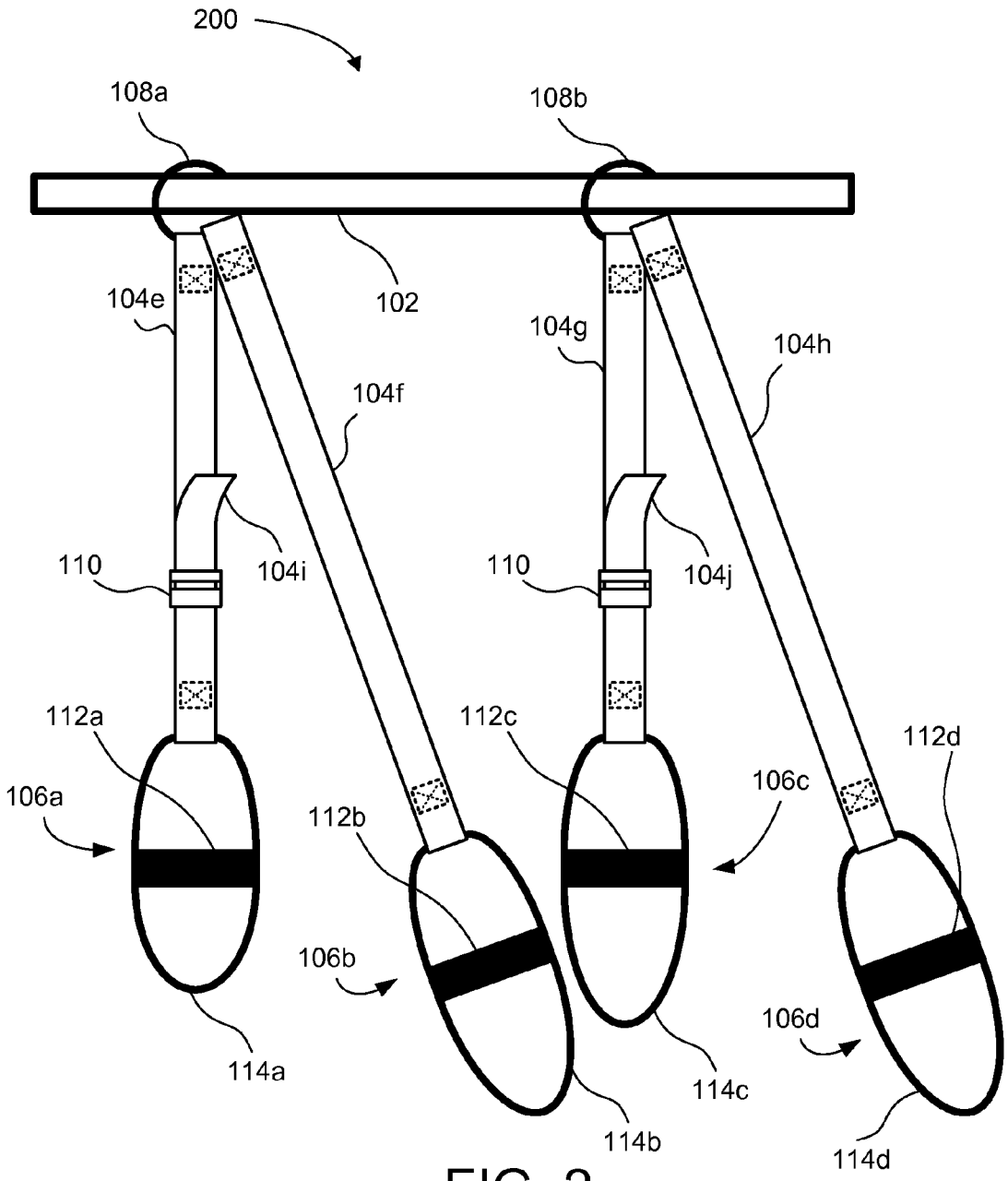
FIG. 2 depicts one embodiment of a fitness device for suspending a user in the air with adjustable straps and elastic straps.

FIG. 2 depicts one embodiment of a fitness device 200 for suspending a user in the air with adjustable straps, 104*e* and 104*g*, and elastic straps, 104*f* and 104*h*. Although the illustrated fitness device 200 is shown and described with certain components and functionality, other embodiments of the fitness device 200 may include fewer or more components to implement less or more functionality. With reference to FIG. 2, four strap units are shown. The illustrated strap units include holds 106*a*-106*d* (for a hand or foot) attached to adjustable straps 104*e* and 104*g* and stretchable or elastic straps 104*f* and 104*h*. Adjustable straps 104*e* and 104*g* are adjustable via adjustment mechanisms or tension lock buckles 110. The other end of the straps 104*e*-104*h* includes or is attached to attachment members 108*a* and 108*b*.

Any type of hold may be implemented. The illustrated holds 106*a*-106*d* include handles 112*a*-112*d*, loops 114*a*-114*d* extending away from the handles 112*a*-112*d*, and another loop attached to the straps 104*e*-104*h*. The handles 112*a*-112*d* may be used as a hold for a hand or a foot. Similarly, the loops 114*a*-114*d* extending away from the handles 112*a*-112*d* may be used as a hold for a hand or a foot. Other embodiments may use other types of holds. Some holds may be specifically configured as a hand hold. Some holds may be specifically configured as a foot hold. Additionally, some holds may be a suitable size to accommodate two hands or two feet. Other holds may have two separate hold locations connected together. The connection between the connected holds may be static so that there is not substantial movement between the connected holds. Alternatively, the connection between the connected holds may be dynamic to allow movement between the connected holds.

Straps 104*e*-104*h* may vary in type, material, style, length, adjustability, and other factors. In the illustrated embodiment, straps 104*e* and 104*g* are adjustable in length. Straps 104*e* and 104*g* employ the use of tension lock buckles 110 to adjust the length of the straps. For example, pulling on the strap segment 104*i* will shorten the length of strap 104*e* via the tension lock buckle 110. Adjusting the tension lock buckle 110 to shorten the strap segment 104*i* will lengthen the strap 104*e*, thereby increasing the length of the strap between the hold 106*a* and the attachment member 108*a*. Those skilled in the art will recognize other ways and other mechanisms that allow the length to be adjusted between the holds and the suspension point or attachment members and are not all described herein, for the sake of brevity. By way of example, though, the length may be adjustable by adjusting where the holds interface with the straps or adjusting where along the straps they are attached to an attachment member.

Straps 104*e*-104*h* may be made of any suitable material to support the weight and movements of a user. In one embodiment, the straps are made of nylon webbing or another type of woven webbing, or rope. In the illustrated embodiment, straps 104*f* and 104*h* are not adjustable in length, however, they may be made of an elastic material to allow the straps 104*f* and 104*h* to stretch and retract during a workout, thereby decreasing impact and increasing dynamic resistance. In some embodiments, the straps are static and may be neither adjustable nor stretchable.

Straps 104*e*-104*h* are connected to attachment members 108*a* and 108*b*. Attachment members 108*a* and 108*b* attach the straps 104*e*-10*h* to the mounting support structure 102. In the illustrated embodiment, the mounting support structure 102 is a bar, which may be attached to a solid surface or attached to a suitable mounting frame.

Figure 3:
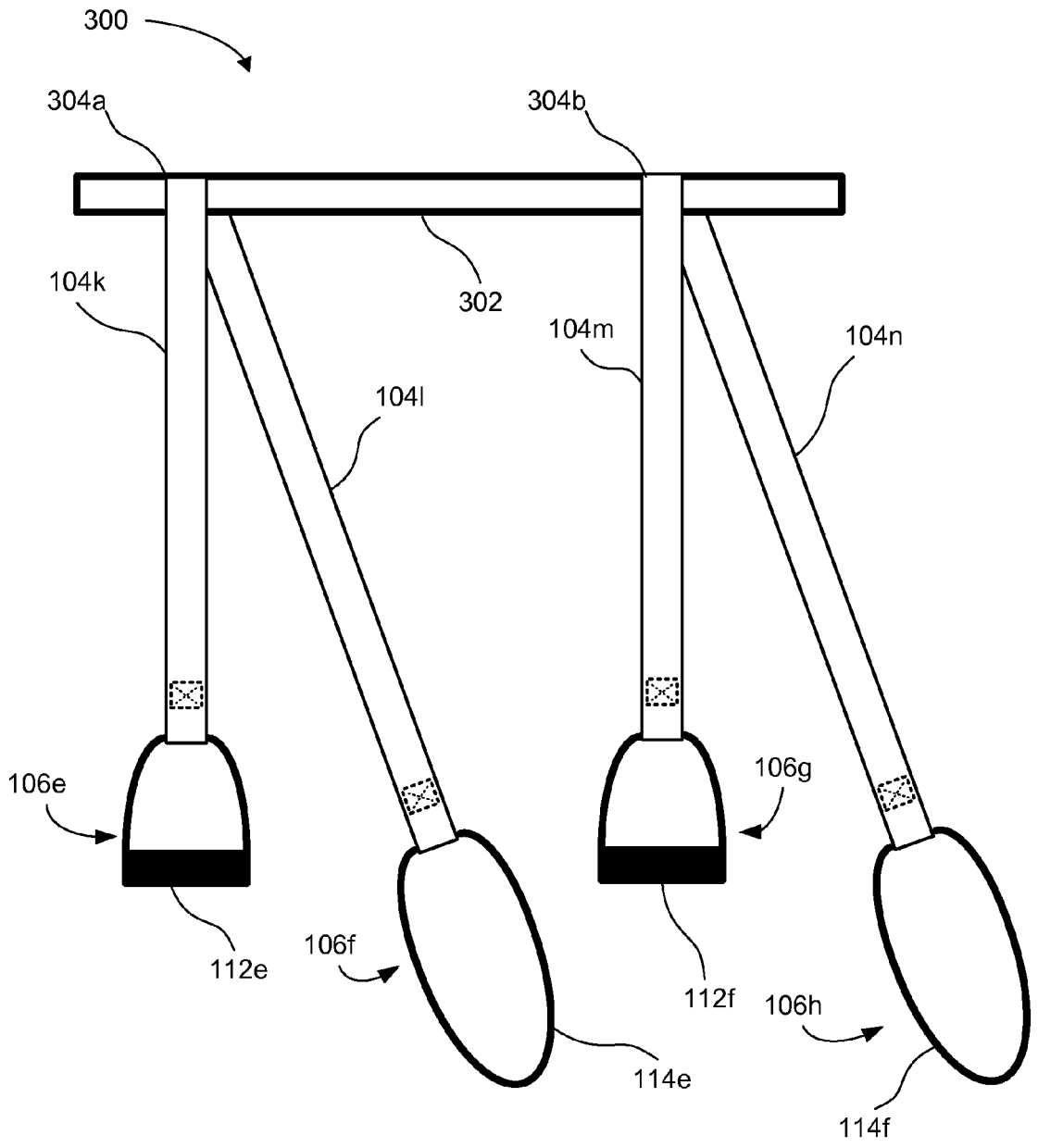
FIG. 3 depicts another embodiment of a fitness device for suspending a user in the air.

FIG. 3 depicts another embodiment of a fitness device 300 for suspending a user in the air. The fitness device 300 has many features similar to those that are described in FIGS. 1 and 2. In the illustrated embodiment of FIG. 3, strap segments 104*k* and 104*l* are segments of one strap. Similarly, strap segments 104*m* and 104*n* are segments of one strap. The straps are supported by bar 302 and are made of a static material. Hold 106*a* is attached to one end of strap segment 104*k*. Hold 106*e* includes a loop and a handle 112*e*. The handle 112*e* may interface with a hand or foot of the user. Hold 106*f* includes a loop 114*e* that may interface with a hand or a foot of the user. Hold 106*g* includes a loop and a handle 112*f*. The handle 112*f* may interface with a hand or foot of the user. Hold 106*h* includes a loop 114*f* that may interface with a hand or a foot of the user.

As strap segments 104*k* and 104*l* are segments of one strap, when the user pulls on the handle 106*e*, strap segment 104*k* may lengthen and increase the distance from hold 106*e* to suspension point 304*a* and simultaneously shorten strap segment 104*l* and decrease the distance from hold 106*f* to suspension point 304*a*. When the user pulls on the hold 106*f*, strap segment 104*l* may lengthen and increase the distance from hold 106*f* to suspension point 304*a* and simultaneously shorten strap segment 104*k* and decrease the distance from hold 106*e* to suspension point 304*a*. Similarly, when the user pulls on the hold 106*g*, strap segment 104*m* may lengthen and increase the distance from hold 106*g* to suspension point 304*b* and simultaneously shorten strap segment 104*n* and decrease the distance from hold 106*h* to suspension point 304*b*. When the user pulls on the hold 106*h*, strap segment 104*n* may lengthen and increase the distance from hold 106*h* to suspension point 304*b* and simultaneously shorten strap segment 104*m* and decrease the distance from hold 106*g* to suspension point 304*b*. Bar 302 may utilize bearing, pulleys, or other mechanisms or a smooth surface to allow for the handles 106*e*-106*h* to change the distance relative to the bar 302. In the illustrated embodiment, a primarily hand hold 106*e* is paired with a primarily foot hold 106*f*. In some embodiment, the hand holds may be paired together or another combination of hands, feet, or hand and foot may be paired.

Figure 4:
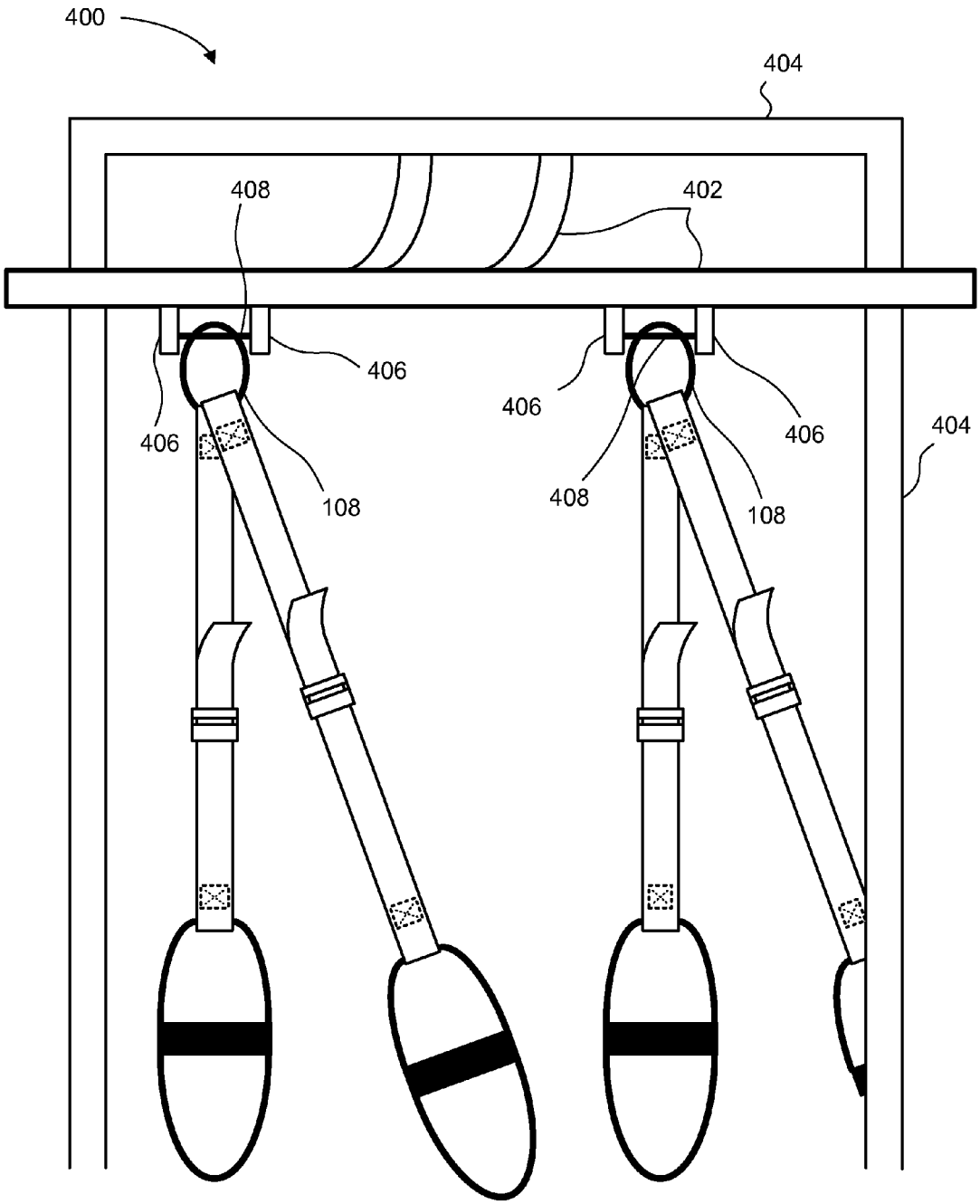
FIG. 4 depicts another embodiment of a fitness system for fully suspending a user in the air to exercise.

FIG. 4 depicts another embodiment of a fitness system 400 for fully suspending a user in the air to exercise. The fitness system 400 has many features similar to those that are described in FIGS. 1-3 above and are not specifically described again.

FIG. 4 depicts a pull-up bar station 402 mounted within a door frame 404. The pull-up bar station 402 and the door frame 404 may be the mounting support structure. The pull-up bar station 402 includes brackets 406 and pins 408. The pin 408 sits between brackets 406 to allow the attachment member 108 to be attached to the mounting support structure. The attachment member 108 may be any type of mechanical structure suitable to connect one or more straps to a corresponding mounting support structure (not shown). Some examples of attachment members include, but are not limited to, rings (D-rings, O-rings, etc.), grommets, loops, and carabiners.

Figure 5:
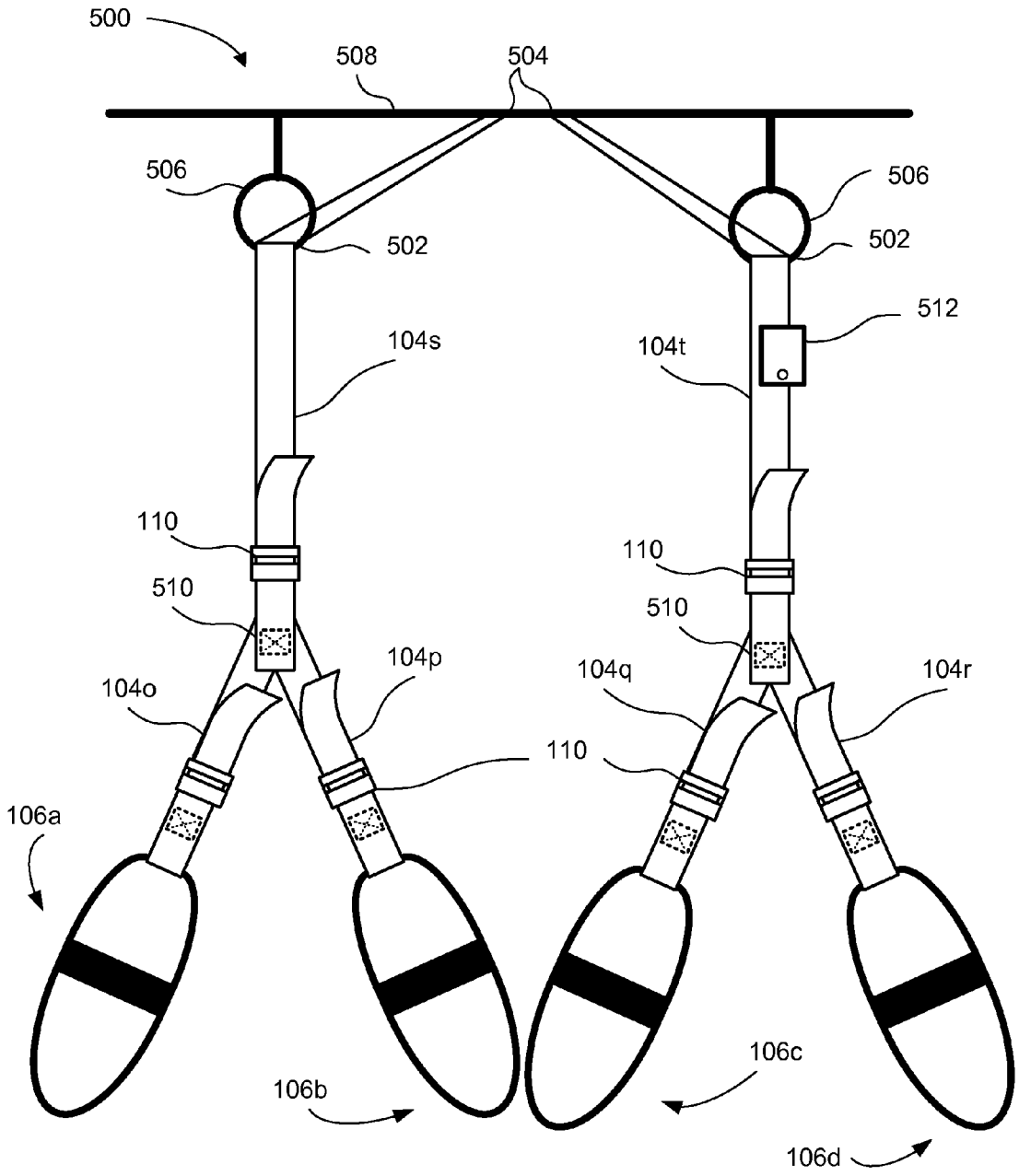
FIG. 5 depicts one embodiment of a fitness device with separate suspension points and mounting points.

FIG. 5 depicts one embodiment of a fitness system 500 with suspension points 502 separate from mounting points 504. The illustrated embodiment depicts two leader straps

104*o* and 104*p* extending from a common strap 104*s*. Two leader straps 104*q* and 104*r* extend from common strap 104*t*. Some embodiments may include two or more leader straps extending from a common strap attached to an attachment member. For example, four leader straps may extend from a single common strap. Every section of the straps may be independently adjustable via tension lock buckles 110 or other length adjustment mechanisms. The straps 104*o*-104*t* may be made of any suitable material to support the weight and movements of the user.

In the illustrated embodiment, the common strap 104*s* is not attached at the ring 506. The ring 506 provides a suspension point 502 and common strap 104*s* is attached at an attachment point or mounting point 504. Mounting point 504 is attached to a ceiling 508. The mounting point 508 could be on a wall, floor, or another mounting structure. The suspension point and the mounting point may be separate. Some embodiment may use a leverage structure as the suspension point for the straps, and use a different mounting point of the straps. For example, the straps mount to a wall, but extend over a horizontal bar located at a distance from the wall. In this example, the horizontal bar provides a suspension point because the user would suspend below the horizontal bar, even though the mounting point is not above the user.

An accessory 512 may be attached to a strap unit. FIG. 5 illustrates a mobile device attached to the strap 104*t* near the ring 506. Examples of accessories include, but are not limited to, pads, electronics, timers, motion sensors, counters, tags, touch sensors, cameras, music players, strain gauges, and so forth. An accessory may attach to the strap using a clamp, Velcro (or another similar engagement material), hooks, and so forth.

FIGS. 1-5 describe many features and functions of embodiments. Although not describe, such features and functions may be combined in any suitable manner. Other embodiments may include two straps to attach to chains on a swing of a swing set. Each strap can attach to a separate chain. Alternatively, two or more straps can attach to the same chain. The user can utilize holds attached to the strap in combination with the seating platform of the swing in order for the user to achieve a full-suspended fitness position. Other embodiments may include a mounting support structure to attach to a piece of outdoor equipment such as a vertical or horizontal pole of a swing set. The mounting support structure includes a strap, clamp, brace, or other mechanical attachment to attach the mounting support structure to the supporting equipment. The mounting support structure also includes one or more attachment points to attach one or more strap units. Other embodiments may include more than four straps for a single user, three handles/holds for a single user, or four holds for a single user. Other embodiments may include an attachment structure for straps used by different users.

Straps may be static with substantially no elasticity or dynamic with some amount of elasticity. The elasticity may be over the full length of the straps or over a fractional portion of the straps. The elasticity may be implemented to limit the fully-stretched length of the strap within a specific range. Any combination of static and dynamic straps may be used and each strap may be individually adjustable in length. Any number of straps attached to a single attachment member. Some embodiments may include dynamic movement of two corresponding straps, so that movement of one strap results in corresponding movement of another strap. In one embodiment, the attachment member may allow movement of the strap relative to the attachment member. For example, pulling on one strap increases the strap length between the hold and the attachment member, and simultaneously decreases the strap length of another strap. The increased strap length of the first strap corresponds to the decreased strap length of the second strap. Some embodiments may include dynamic movement of more than two corresponding straps. Pulling on one strap results in changing the length of two or more corresponding straps Some embodiments may include Some embodiments may include straps that have relatively small cross-sectional areas and substantially fixed cross-sectional geometries in order to provide a simple system that does not tend to interfere with the user. Some embodiments are specifically implemented with adjustable straps that allow a user to independently change the length of the strap between the attachment member and the corresponding hold(s).

Figure 6:
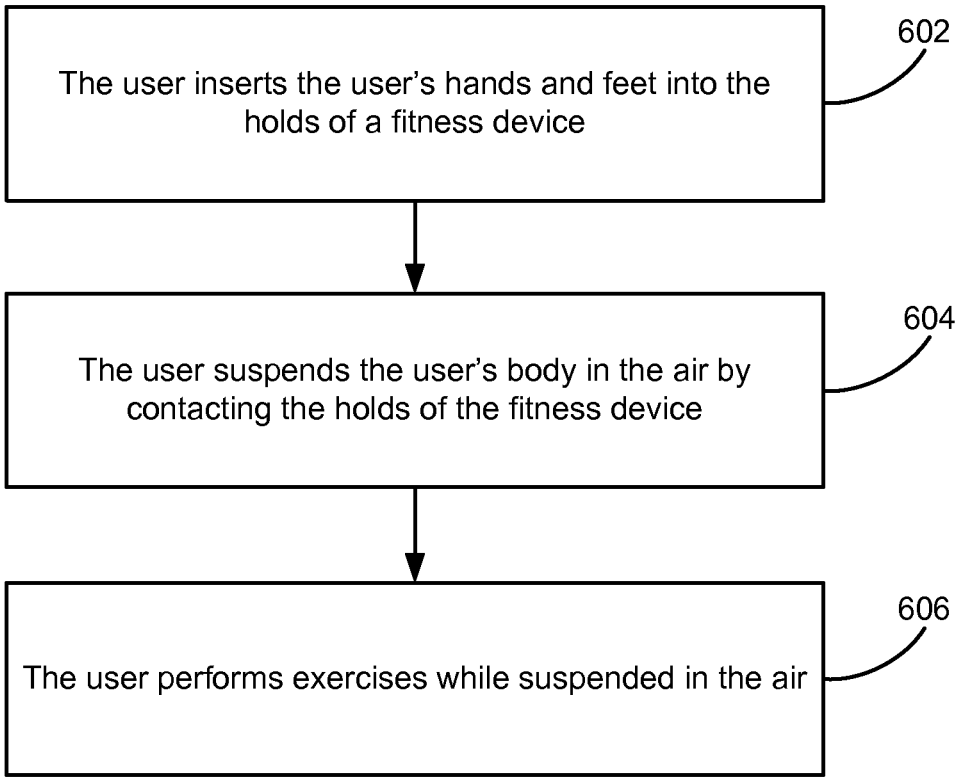
FIG. 6 depicts a schematic diagram of one embodiment of a method for fully suspending a user in the air by fitness straps.

FIG. 6 depicts a schematic diagram of one embodiment of a method 600 for fully suspending a user in the air by fitness straps. Although, the method 600 is described in conjunction with FIGS. 1-5 above, the method may be accomplished via alternative embodiments.

At block 602, a user inserts the user's hands and feet into the holds 106*a*-106*d* of four strap segments 104*a*-104*d* of a fitness device. The fitness device includes at least four holds 106*a*-106*d*, at least four strap segments 104*a*-104*d*, and at least one attachment member 108*a*. Each hold 106*a*-106*d* is configured to allow a user to interface with a hand or a foot. The four holds 106*a*-106*d* are configured to allow a single user to concurrently interface the four holds with a separate hand or foot. At least one strap segment 104*a* is adjustable in length between the corresponding hold 106*a* and a suspension point. The strap segments 104*a*-104*d* are configured to move independently of each other strap segment 104*a*-104*d*. The at least one attachment member 108*a* is configured to attach to a corresponding mounting support structure 102 to enable a user to fully suspend the user's body from a ground surface by contact with the holds 106*a*-106*d*.

At block 604, the user suspends himself or herself by only contacting the four holds 106*a*-106*d*. At block 606, the user performs exercises while suspended in the air. The depicted method 600 then ends.

In some embodiments, the method further includes the user performing a running motion with the arms and legs of the user while suspended in the air. Other exercises, such as cardio exercises and strength training exercises, may be performed as well. In some embodiments, the user performs exercises while suspended in air and may pull on one strap segment to lengthen the length between the corresponding hold and suspension point. The pulling of the one strap may shorten the length of a second strap segment between the second strap segment's corresponding hold and suspension point.

Many of the features and descriptions of FIGS. 1-5, although not specifically outlined with FIG. 6, may yet be applied to the method 600. They are not specifically outlined for the sake of brevity.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although the operations of the method(s) herein may be shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A fitness device for fully suspending a user in air, the fitness device comprising:

at least four holds, wherein each hold is configured to allow a user to interface with a hand or a foot, wherein the four holds are configured to allow a single user to concurrently interface the four holds with a separate hand or foot;

at least four strap segments, wherein at least one strap segment is adjustable in length between a corresponding hold and a suspension point, wherein the strap segments are configured to move independently of each other strap segment; and at least one attachment member, wherein the at least one attachment member is configured to attach to a corresponding mounting support structure to enable a user to fully suspend the user's body from a ground surface by contact with the holds, wherein the mounting support structure is a pull-up bar station configured to mount within a door frame, wherein the pull-up bar station comprises a pin spanning between brackets, the brackets attached to the pull-up bar station, the brackets fixedly rigid relative to a cross-bar configured to span across the door frame, wherein the at least one attachment member is configured to attach at the pin, wherein a longitudinal axis of the pin is fixedly parallel to a longitudinal axis of the cross-bar.

2. The fitness device for fully suspending a user in air of claim 1, wherein the at least four holds and the at least four strap segments are further configured to facilitate the user to fully-suspend the user solely from the holds, in an absence of an additional supporting member for the user's torso.

3. The fitness device for fully suspending a user in air of claim 1, wherein the at least four strap segments are independent straps individually connected to at least one attachment member.

4. The fitness device for fully suspending a user in air of claim 3, the fitness device further comprising two attachment members, wherein a first strap segment and a second strap segment attach to a first attachment member, and wherein a third strap segment and a fourth strap segment attach to a second attachment member.

5. The fitness device for fully suspending a user in air of claim 1, wherein all strap segments are individually adjustable in length between a corresponding hold and a corresponding suspension point, and wherein two of the at least four strap segments extend from a first common strap, and wherein two of the at least four strap segments extend from a second common strap, wherein each of the strap segments is independently adjustable and wherein the first and second common strap are each independently adjustable.

6. The fitness device for fully suspending a user in air of claim 1, the fitness device further comprising at least two suspension points, wherein a first suspension point suspends a first and second strap segment, and wherein a second suspension point suspends a third and fourth strap segment.

7. The fitness device for fully suspending a user in air of claim 1, wherein the suspension point for each strap segment is one of the at least one attachment members.

8. The fitness device for fully suspending a user in air of claim 1, wherein at least one strap segment comprises an elastic material configured to stretch.

9. The fitness device for fully suspending a user in air of claim 1, wherein at least two strap segments are adjustable in length, wherein adjusting a length of the first of the at least two strap segments adjusts a length for the second of the at least two strap segments by an equal amount.

10. A method for fully suspending a user in air by fitness straps, the method comprising:

inserting a user's hands and feet into holds of a fitness device comprising:

at least four holds, wherein each hold is configured to allow a user to interface with a hand or a foot, wherein the four holds are configured to allow a single user to concurrently interface the four holds with a separate hand or foot;

at least four strap segments, wherein at least one strap segment is adjustable in length between a corresponding hold and a suspension point, wherein the strap segments are configured to move independently of each other strap segment; and at least one attachment member, wherein the at least one attachment member is configured to attach to a corresponding mounting support structure to enable a user to fully suspend the user's body from a ground surface by contact with the holds, wherein the mounting support structure is a pull-up bar station configured to mount within a door frame, wherein the pull-up bar station comprises a pin spanning between brackets, the brackets attached to the pull-up bar station, the brackets fixedly rigid relative to a cross-bar configured to span across the door frame, wherein the at least one attachment member is configured to attach at the pin, wherein a longitudinal axis of the pin is fixedly parallel to a longitudinal axis of the cross-bar;

suspending the user in air by contacting the four holds.

11. The method for fully suspending a user in air by fitness straps of claim 10, the method further comprising the user contacting only the four holds to suspend the user in the air.

12. The method for fully suspending a user in air by fitness straps of claim 10, the method further comprising the user performing a running motion with the arms and legs of the user while suspended in the air.

13. The method for fully suspending a user in air by fitness straps of claim 10, the method further comprising the user performing exercises while suspended in air and pulling one strap segment to lengthen the length between the corresponding hold and suspension point, wherein the pulling of the one strap shortens the length of another strap segment between the another strap segment's corresponding hold and suspension point.

14. The method for fully suspending a user in air by fitness straps of claim 10, the fitness device further comprising two attachment members, wherein a first strap segment and a second strap segment attach to a first attachment member, and wherein a third strap segment and a fourth strap segment attach to a second attachment member.

15. A fitness system for fully suspending a user in air to exercise, the fitness system comprising:

a mounting support structure, wherein the mounting support structure is a pull-up bar station configured to mount within a door frame; and a strap structure connected to the mounting support structure, the strap structure comprising:

at least four holds, wherein each hold is configured to allow a user to interface with a hand or a foot, wherein the four holds are configured to allow a single user to concurrently interface the four holds with a separate hand or foot;

at least four strap segments, wherein at least one strap segment is adjustable in length between a corresponding hold and a suspension point, wherein the strap segments are configured to move independently of each other strap segment; and at least one attachment member, wherein the at least one attachment member is configured to attach to the mounting support structure to enable a user to fully suspend the user's body from a ground surface by contact with the holds, wherein the pull-up bar station comprises a pin spanning between brackets, the brackets attached to the pull-up bar station, the brackets fixedly rigid relative to a cross-bar configured to span across the door frame, wherein the at least one attachment member is configured to attach at the pin, wherein a longitudinal axis of the pin is fixedly parallel to a longitudinal axis of the cross-bar.

16. The fitness system for fully suspending a user in air to exercise of claim 15, wherein two of the at least four strap segments extend from a first common strap, and wherein two of the at least four strap segments extend from a second common strap, wherein each of the strap segments is independently adjustable and wherein the first and second common strap are each independently adjustable.

17. The fitness system for fully suspending a user in air to exercise of claim 15, wherein the at least one attachment member comprises a carabiner or ring to connect the strap segments to the mounting support structure.

18. The fitness system for fully suspending a user in air to exercise of claim 15, the strap structure further comprising two attachment members, wherein a first strap segment and a second strap segment attach to a first attachment member, and wherein a third strap segment and a fourth strap segment attach to a second attachment member.

* * * * *